US010621924B2

(12) United States Patent
Chang et al.

(10) Patent No.: US 10,621,924 B2
(45) Date of Patent: Apr. 14, 2020

(54) DISPLAY PANEL DRIVING CIRCUIT AND METHOD FOR CAPTURING DRIVING CIRCUIT ERROR INFORMATION THEREOF

(71) Applicant: Novatek Microelectronics Corp., Hsinchu (TW)

(72) Inventors: Hua-Gang Chang, Hsinchu County (TW); Kuei-Chung Chang, Hsinchu County (TW)

(73) Assignee: Novatek Microelectronics Corp., Hsinchu (TW)

( * ) Notice: Subject to any disclaimer, the term of this patent is extended or adjusted under 35 U.S.C. 154(b) by 0 days.

(21) Appl. No.: 16/120,460

(22) Filed: Sep. 4, 2018

(65) Prior Publication Data

US 2019/0139497 A1 May 9, 2019

Related U.S. Application Data

(60) Provisional application No. 62/582,955, filed on Nov. 8, 2017.

(51) Int. Cl.
*G09G 3/3291* (2016.01)
*G09G 3/3283* (2016.01)
(Continued)

(52) U.S. Cl.
CPC ..... *G09G 3/3291* (2013.01); *G09G 3/3233* (2013.01); *G09G 3/3258* (2013.01);
(Continued)

(58) Field of Classification Search
CPC .. G09G 3/3233; G09G 3/3258; G09G 3/3283; G09G 3/3291; G09G 2300/0819;
(Continued)

(56) References Cited

U.S. PATENT DOCUMENTS

2013/0200821 A1* 8/2013 Yoneoka ..... H05B 37/03 315/297
2016/0078800 A1* 3/2016 Ha ..... G09G 3/32 315/209 R
(Continued)

FOREIGN PATENT DOCUMENTS

CN 105047137 11/2015
TW 200641775 12/2006
(Continued)

OTHER PUBLICATIONS

"Office Action of Taiwan Counterpart Application," dated Aug. 28, 2019, p. 1-p. 7.

*Primary Examiner* — Nelson M Rosario
(74) *Attorney, Agent, or Firm* — JCIPRNET

(57) ABSTRACT

The invention provides a display panel driving circuit and a method for capturing error information thereof. The display panel driving circuit includes a driving circuit, a pixel circuit and a timing controller circuit. The method includes: obtaining LED error information indicating errors caused by an LED of the pixel circuit; driving the LED by the drive circuit to obtain LED and driving circuit error information; obtaining driving circuit error information according to the two error information. The timing controller circuit records the error information and compensates LED attenuation by using the error information.

29 Claims, 6 Drawing Sheets

(51) Int. Cl.
*G09G 3/3233* (2016.01)
*G09G 3/3258* (2016.01)

(52) U.S. Cl.
CPC ... *G09G 3/3283* (2013.01); *G09G 2300/0819* (2013.01); *G09G 2310/08* (2013.01); *G09G 2320/0285* (2013.01)

(58) Field of Classification Search
CPC ..... G09G 2310/08; G09G 2320/0285; G09G 2320/0233; G09G 2320/0295; G09G 2320/045
See application file for complete search history.

(56) References Cited

U.S. PATENT DOCUMENTS

| | | | | |
|---|---|---|---|---|
| 2016/0078821 | A1 | 3/2016 | Lee et al. | |
| 2017/0039021 | A1* | 2/2017 | Hall | G09F 9/3023 |

FOREIGN PATENT DOCUMENTS

| | | |
|---|---|---|
| TW | 201426708 | 7/2014 |
| TW | 201618071 | 5/2016 |

* cited by examiner

DISPLAY PANEL DRIVING CIRCUIT AND METHOD FOR CAPTURING DRIVING CIRCUIT ERROR INFORMATION THEREOF

CROSS-REFERENCE TO RELATED APPLICATION

This application claims the priority benefit of U.S. provisional application Ser. No. 62/582,955, filed on Nov. 8, 2017. The entirety of the above-mentioned patent application is hereby incorporated by reference herein and made a part of this specification.

BACKGROUND

Field of the Invention

The invention relates to a display apparatus and more particularly to a display panel driving circuit and a method for capturing error information thereof.

Description of Related Art

Many display apparatuses are equipped with light-emitting diode (LED) display panels, such as organic light-emitting diode (OLED) display panels. After the OLED has been used for a period of time, a phenomenon of decay occurs, and as a result, a relation between a voltage and a current of two terminals of the OLED appears to drift along with time. The phenomenon of decay would cause an issue of uneven panel brightness. In order to compensate the issue of uneven panel brightness caused by the LED decay, a possible compensation method may be electrical compensation. According to the principle of electrical compensation, a given current is supplied from a source driving circuit to an OLED of a pixel circuit, and then a voltage of the OLED is detected by the source driving circuit, or alternatively, the given current is supplied from the source driving circuit to the OLED of a pixel circuit, and then a current of the OLED is detected by the source driving circuit. According to the difference between a reference voltage-current relation between a current voltage-current relation of the OLED, a control circuit (for example, a timing controller) may compensate pixel data.

However, in either the scenario that "the current is supplied to the OLED, and then the voltage of the OLED is detected", or the scenario that "the voltage is supplied by the OLED, and then the current of the OLED is detected", a part of the supply or the detection is certainly performed in a form of current. Due to errors in a transistor manufacturing process, a current error that cannot be ignored exists in each source driving circuit. The current-voltage relation of the OLED caused by the current errors of the source driving circuit cannot be accurately obtained. Namely, in the presence of the current errors of the source driving circuit, the electrical compensation cannot be performed accurately on the OLED.

SUMMARY

The disclosure provides a display panel driving circuit and a method for capturing error information thereof to obtain driving circuit error information.

According to an embodiment of the invention, a method for capturing driving circuit error information indicating errors caused by a source driving circuit for driving a light-emitting diode (LED) display panel is provided. The method includes: obtaining LED error information indicating errors caused by an LED of a pixel circuit; driving the LED display panel by the source driving circuit to obtain LED and driving circuit error information indicating errors caused by the LED and a sensing current or a driving current of the source driving circuit; and obtaining source driving circuit error information according to the LED error information and the LED and driving circuit error information, wherein the driving circuit error information indicates errors caused by the sensing current or the driving current of the source driving circuit.

According to an embodiment of the invention, a driving circuit for driving a LED display panel is provided. The LED display panel includes at least one pixel circuit, and the pixel circuit includes at least one field-effect transistor and an LED. The pixel circuit is connected to a data line and a sensing line of the LED display panel. The driving circuit includes a timing controller circuit. The timing controller circuit is configured to control a source driving circuit to drive the data line of the LED display panel and sense the sensing line of the LED display panel. In a detection operation period, the timing controller circuit is configured to obtain errors caused by a driving current or a sensing current of the source driving circuit (which is driving circuit error information). The timing controller circuit obtains original LED sensing data from the source driving circuit in the detection operation period. Based on the source driving circuit error information, the timing controller circuit compensates the original LED sensing data to generate LED error information indicating errors caused by the LED of the pixel circuit.

According to an embodiment of the invention, a driving circuit for driving a light-emitting diode (LED) display panel is provided. The LED display panel includes at least one pixel circuit, and the pixel circuit includes at least one field-effect transistor and an LED. The pixel circuit is connected to a data line and a sensing line of the LED display panel. The driving circuit includes a timing controller circuit. The timing controller circuit is configured to control a source driving circuit to drive the data line of the LED display panel and sense the sensing line of the LED display panel. In a normal operation period, the timing controller circuit is configured to obtain first LED error information indicating errors caused by the LED of the pixel circuit. In a detection operation period before the normal operation period, the timing controller circuit generates and stores or updates the first LED error information. The timing controller circuit obtains original pixel data in the normal operation period and compensates the original pixel data by using the first LED error information to generate compensated pixel data. The timing controller circuit provides the compensate pixel data to the source driving circuit in the normal operation period, such that the source driving circuit drives the LED display panel according to the compensated pixel data.

To sum up, the display panel and the method for capturing the error information thereof provided by the embodiments of the invention can obtain the errors caused by the LED of the pixel circuit (which is the LED error information) and obtain the errors caused by the LED and the sensing current (or the driving current) of the driving circuit (which is the LED and driving circuit error information). According to the LED error information and the LED and driving circuit error information, the driving circuit of the display panel can obtain the errors caused by the sensing current (or the driving current) of the driving circuit (which is the driving circuit error information).

To make the above features and advantages of the invention more comprehensible, embodiments accompanied with drawings are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF EMBODIMENTS

Figure 1:
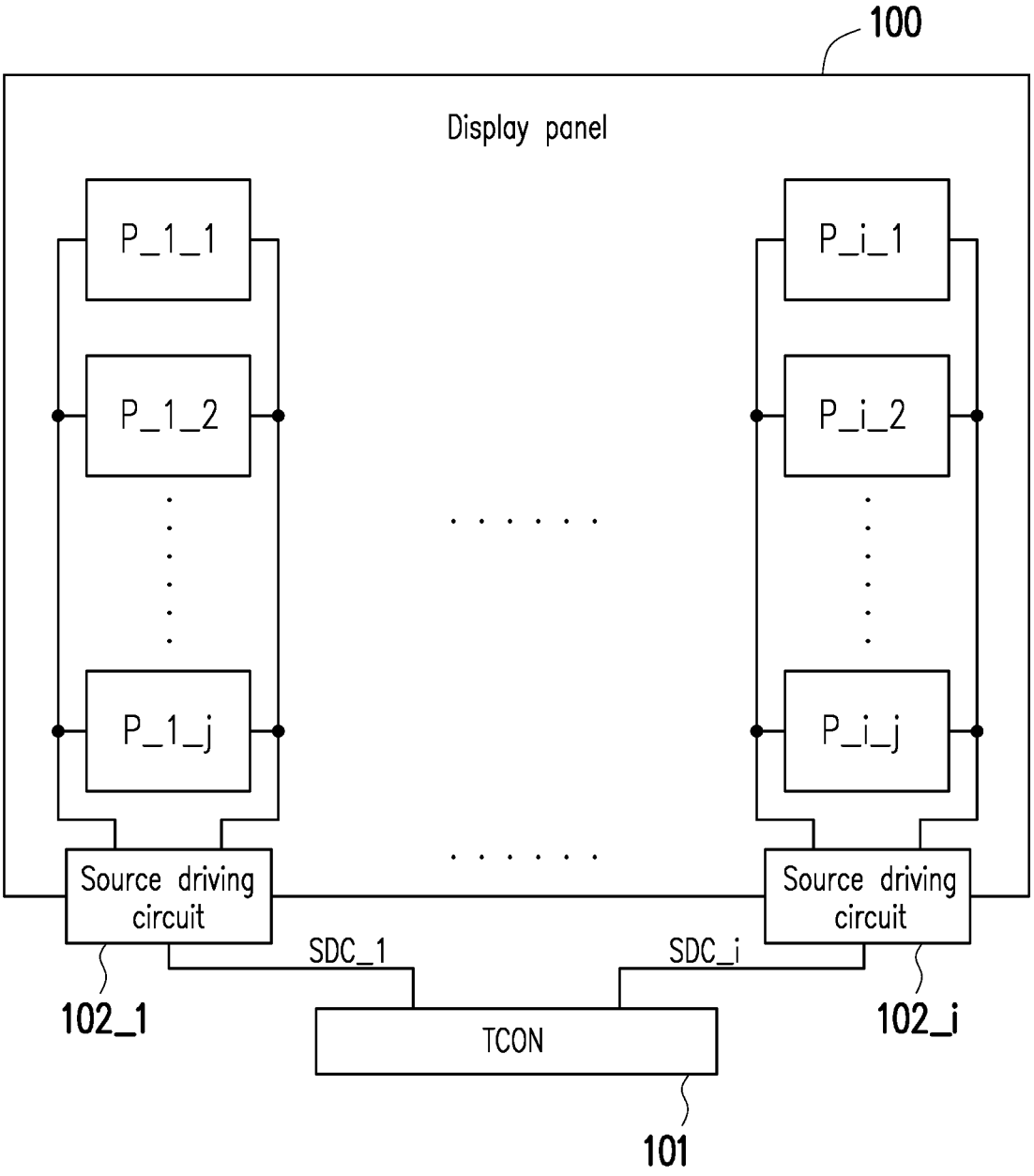
FIG. 1 is a schematic circuit block diagram illustrating a light-emitting diode (LED) display panel and a driving circuit thereof according to one embodiment.

The term "couple (or connect)" herein (including the claims) are used broadly and encompass direct and indirect connection or coupling means. For example, if the disclosure describes a first apparatus being coupled (or connected) to a second apparatus, then it should be interpreted that the first apparatus can be directly connected to the second apparatus, or the first apparatus can be indirectly connected to the second apparatus through other devices or by a certain coupling means. Moreover, elements/components/steps with same reference numerals represent same or similar parts in the drawings and embodiments. Elements/components/notations with the same reference numerals in different embodiments may be referenced to the related description.

FIG. 1 is a schematic circuit block diagram illustrating a light-emitting diode (LED) display panel 100 and a driving circuit thereof according to one embodiment. The driving circuit can include one or more source driving circuits (for example, source driving circuits 102_1, . . . and **102_*i* illustrated in FIG. 1). The driving circuit can further include or be coupled to a timing controller (TCON) circuit 101. Moreover, the driving circuit can include or be coupled to one or more gate driving circuits (which are not shown in FIG. 1). In addition, each source driving circuit of the one or more driving circuit can be coupled to one or more columns of pixel circuits. In addition, the direction is shown only for explanation, and in other embodiments/illustration, each source driving circuit of the one or more driving circuit can be coupled to one or more rows of pixel circuits. For example, the LED display panel 100 may be an organic light-emitting diode (OLED) display panel or other display panels. The LED display panel 100 includes at least one pixel circuit (for example, pixel circuits P_1_1, P_1_2, . . . , P_1**_*j*, . . . , P_i_1, P_i_2, . . . and P_i_j illustrated in FIG. 1). The integers i and j may be determined based on a design requirement. Based on a design requirement, a part of or all of the source driving circuits 102_1-**102_*i*** may be disposed in the same integrated circuit (IC).

The TCON circuit 101 sends control signals (for example, control signals SDC_1, . . . and SDC_i illustrated in FIG. 1) to the source driving circuits 102_1-**102_*i*. Based on the control of the TCON circuit 101, the source driving circuits 102_1-102_*i* and one or more gate driving circuits (which are not shown in FIG. 1) respectively send source driving signals and gate driving signals to the pixel circuits P_1_1-P_i_j, so as to drive LEDs in the pixel circuits P_1_1**-P_i_j to emit light.

Figure 2:
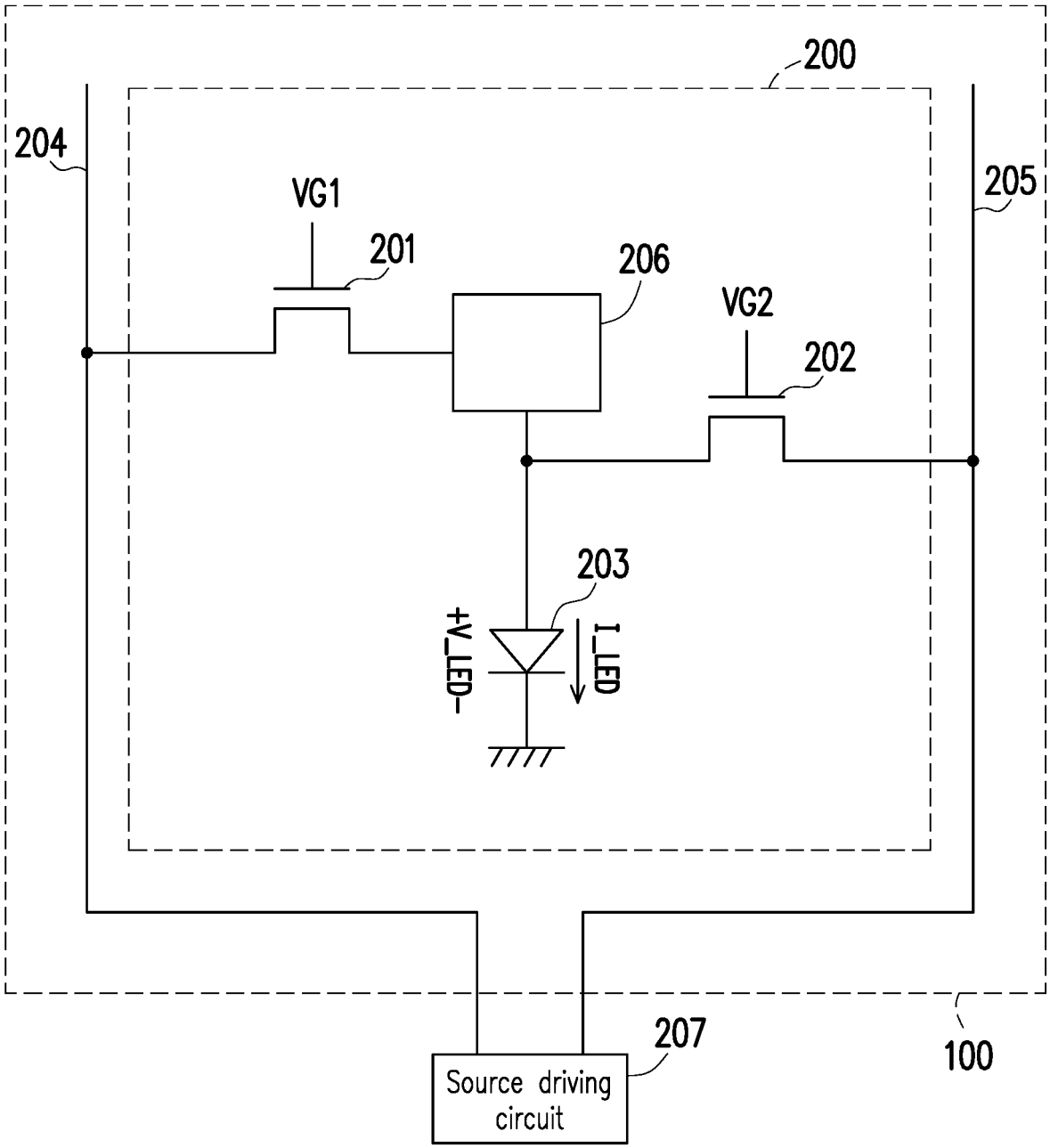
FIG. 2 is a schematic circuit diagram illustrating a pixel circuit according to one embodiment.

FIG. 2 is a schematic circuit diagram illustrating a pixel circuit 200 according to one embodiment. The embodiment shown in FIG. 2 is for a purpose of explanation and other pixel circuits can be employed as the pixel circuit in FIG. 1. The pixel circuit 200 is coupled to a source driving circuit 207 through a data line (source line) 204 and a sensing line 205. The source driving circuit 207 illustrated in FIG. 2 may be inferred with reference to the description related to any one of the source driving circuits 102_1-**102_*i* illustrated in FIG. 1. Any one of the pixel circuits P_1_1-P_i_j illustrated in FIG. 1 may be inferred with reference to the description related to the pixel circuit 200 illustrated in FIG. 2. In the embodiment illustrated in FIG. 2, the pixel circuit 200 includes a switching field-effect transistor (FET) 201, a sensing FET 202, an LED 203 and a driving FET 206. Based on a design requirement, the LED 203** may be an organic light-emitting diode (OLED) display panel or other types of LEDs.

In the embodiment illustrated in FIG. 2, a control terminal (e.g., a gate) of the switching FET 201 is coupled to a scanning line (a gate line, not shown) to receive a gate driving signal VG1. A first terminal (e.g., a source) of the switching FET 201 is coupled to a data line (a source line) 204. A second terminal (e.g., a drain) of the switching FET 201 is coupled to a control terminal (e.g., a gate) of the driving FET 206. Based on the gate driving signal VG1, the switching FET 201 may selectively transmit a source driving signal of the data line 204 to the control terminal of the driving FET 206. The driving FET 206 may provide the driving current I_LED to the LED 203. Based on a signal (a voltage level) of the control terminal of the driving FET 206, the driving FET 206 may adjust the driving current I_LED, so as to adjust a brightness level (a grayscale) of the LED 203.

A first terminal (e.g., a source) of the sensing FET 202 can be coupled to the sensing line 205. A second terminal (e.g., a drain) of the sensing FET 202 can be coupled to the LED 203. A control terminal (e.g., a gate) of the sensing FET 202 is coupled to another scanning line (a gate line, not shown) to receive a control signal VG2. When the sensing FET 202 is turned on, the source driving circuit 207 may sense electrical characteristics (e.g., the driving current I_LED and/or the driving voltage V_LED) of the LED 203.

Figure 3:
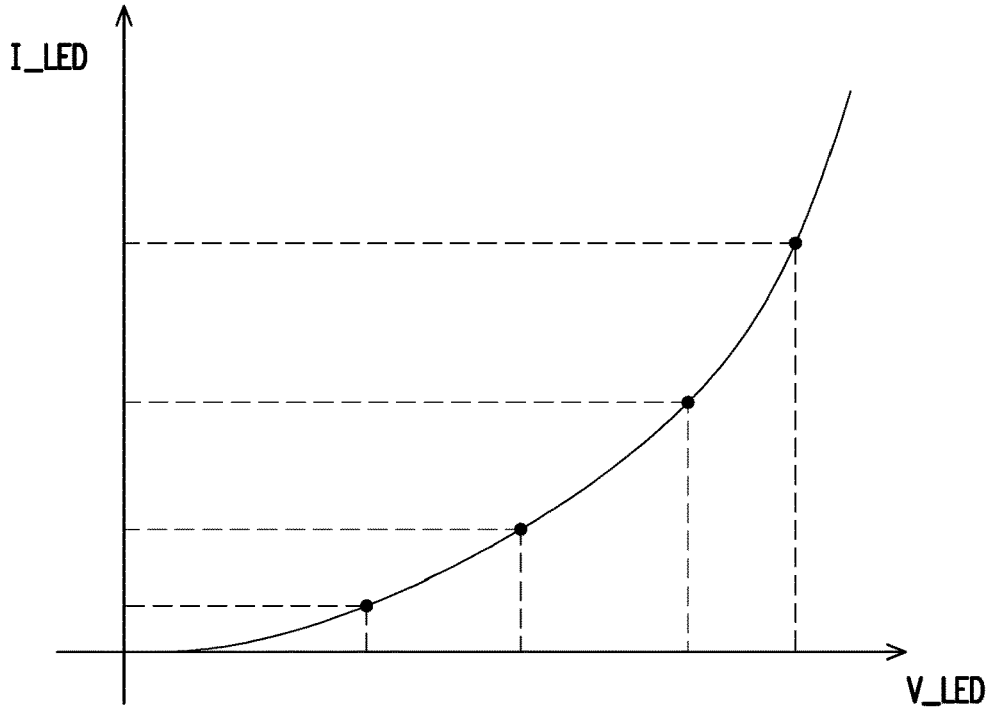
FIG. 3 illustrates a schematic characteristic curve of the driving voltage with respect to the driving current of the LED depicted in FIG. 2 according to one embodiment.

FIG. 3 illustrates a schematic characteristic curve of the driving voltage V_LED with respect to the driving current I_LED of the LED 203 depicted in FIG. 2. In FIG. 3, the horizontal axis represents the driving voltage V_LED of the LED 203, and the vertical axis represents the driving current I_LED of the LED 203. A light-emitting intensity of the LED 203 increases along with the increase of the driving current I_LED (which is a forward current). According to the characteristic curve illustrated in FIG. 3, the driving current I_LED is related to the driving voltage V_LED. After the LED 203 has been used for a period of time, a phenomenon of decay may occur to the LED 203, such that a relation between the driving voltage V_LED and the driving current I_LED appears to drift along with time.

Figure 4:
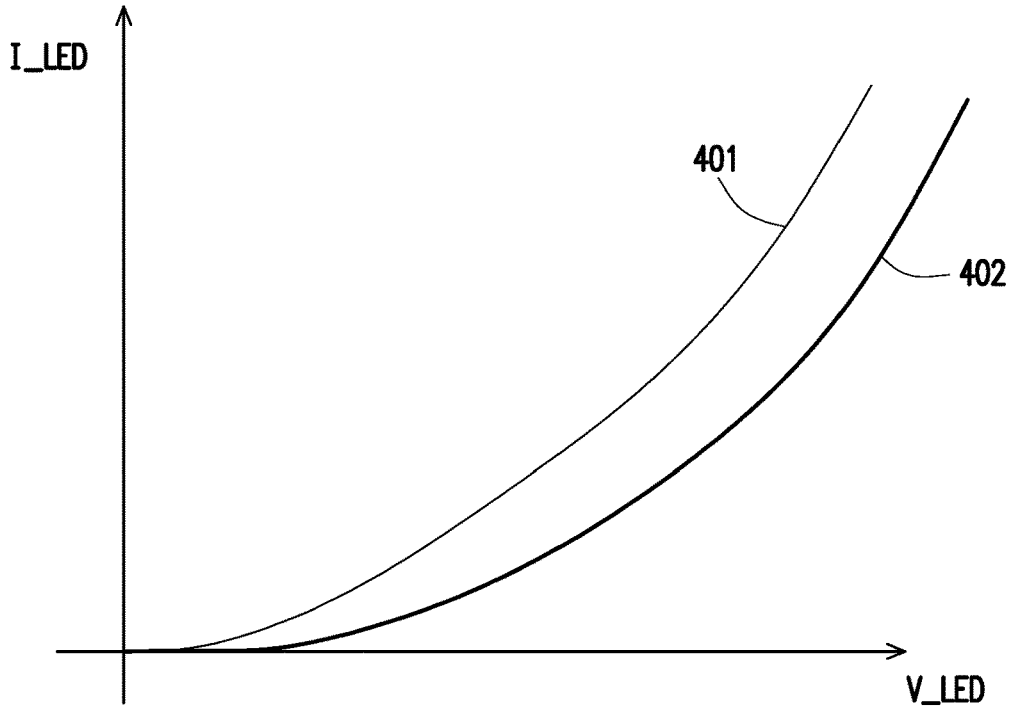
FIG. 4 illustrates the draft appearing to schematic characteristic curves of the voltage with respect to the current of the LED 203 depicted in FIG. 2 due to the decay according to one embodiment.

FIG. 4 illustrates the draft appearing to schematic characteristic curves of the voltage with respect to the current of the LED 203 depicted in FIG. 2 due to the decay. In FIG. 4, the horizontal axis represents the driving voltage V_LED of the LED 203, and the vertical axis represents the driving current I_LED of the LED 203. A characteristic curve 401 illustrated in FIG. 4 shows a characteristic of an initial voltage with respect to the current of the LED 203. After the LED 203 has been used for a period of time, the phenomenon of decay occurs to the LED 203, the characteristic of the initial voltage of the LED 203 with respect to the current drifts from the characteristic curve 401 to a characteristic curve 402. The phenomenon of decay would cause an issue of uneven panel brightness. In order to compensate the issue of uneven panel brightness caused by the decay of the LED 203, a possible compensation method may be electrical compensation.

Figure 5:
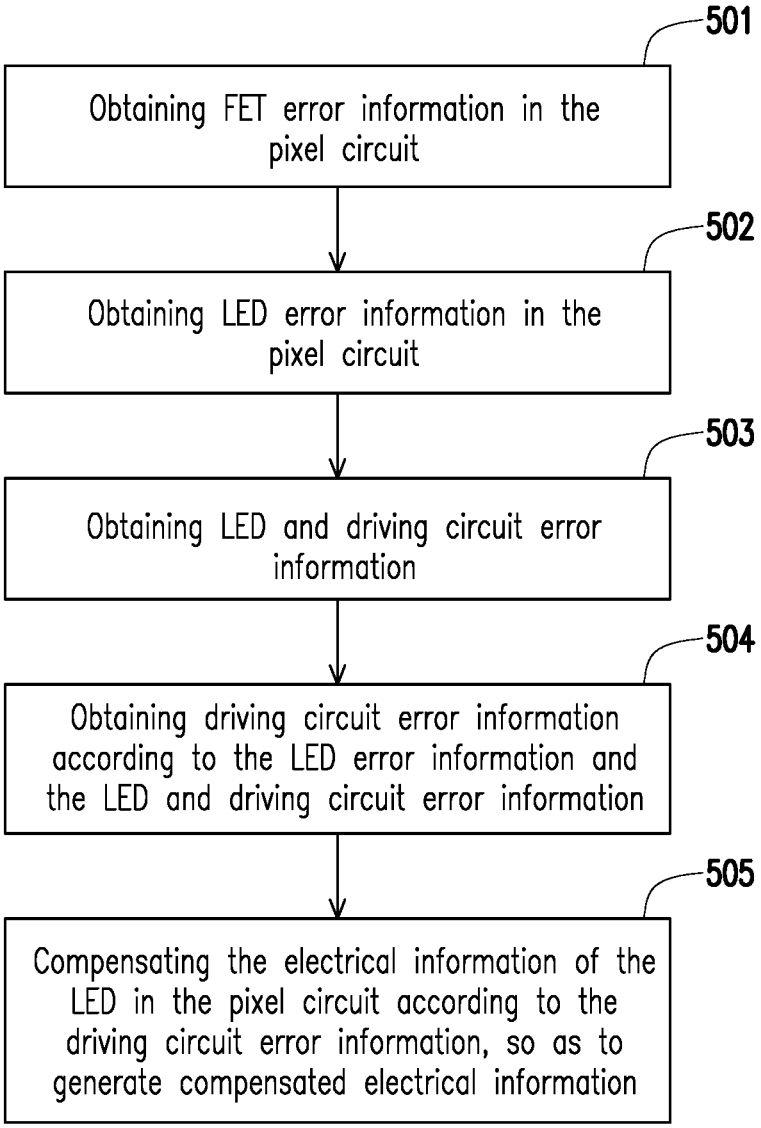
FIG. 5 is a flowchart illustrating a method for capturing error information of a driving circuit according to an embodiment of the invention.

FIG. 5 is a flowchart illustrating a method for capturing error information of a driving circuit according to an embodiment of the invention. FIG. 5 is explained with the TCON circuit 101 in FIGS. 1, 2, and 5 but the application is not limited thereto. Please refer to FIGS. 1, 2 and 5, the TCON circuit 101 may perform steps 501 and 502 to obtain LED error information. The LED error information indicates errors caused by the LED 203 of the pixel circuit 200.

To be detailed, in step 501, the TCON circuit 101 controls the source driving circuit 207, so as to drive the pixel circuit 200. By driving the pixel circuit 200, the TCON circuit 101 may obtain FET error information. The FET error information indicates errors caused by the at least FET (for example, the FETs 201, 202 and/or 206 illustrated in FIG. 2) in the pixel circuit 200. Based on a design requirement, in some embodiments, a conventional electrical compensation method or other methods may be performed in step 501 to obtain electrical error information (i.e., the FET error information) of the FETs 201, 202 and/or 206.

For instance, based on the control of the TCON circuit 101, the source driving circuit 207 may control the LED 203 in the pixel circuit 200 not to emit light, namely, control the driving voltage V_LED to be less than a threshold voltage LED 203. In the premise that the LED 203 is controlled not to emit light, the TCON circuit 101 controls the source driving circuit 207 to sense the at least one FET in the pixel circuit 200 so as to obtain the FET error information. For example, the source driving circuit 207 provides a certain test voltage through the data line 204 to drive the pixel circuit 200 and measures a corresponding voltage through the sensing line 205. The test voltage may be determined based on a design requirement. Based on a relation between the test voltage and the corresponding voltage, the TCON circuit 101 may obtain the electrical error information (i.e., the FET error information) of the FETs 201, 202 and 206. In addition, the TCON circuit 101 may turn on the sensing FET 202 and turn off the switching FET 201 to sense the FETs in the pixel circuit 200, so as to obtain the FET error information. The TCON circuit 101 may record the electrical error information (i.e., the FET error information) of the FETs 201, 202 and 206 in an electrical compensation look-up table. The electrical compensation look-up table may be placed in an FET compensation circuit 610 of a timing controller circuit 101 illustrated in FIG. 6.

The TCON circuit 101, in step 502, may further compensate the original pixel data by using the FET error information to generate the compensated pixel data. There are at least two factors that can cause the issue of uneven panel brightness, one refers to errors caused by the FETs in the pixel circuit, and the other one refers to the errors caused by the LED in the pixel circuit. After the original test data is compensated by using the FET error information, in step 502, the errors caused by the LED may be captured by using an optical instrument. When the compensation for the FETs by using the FET error information is completed, in step 502, based on the control of the TCON circuit 101, the source driving circuit 207 may drive the pixel circuit 200 by using the compensated test data, so as to control the LED 203 to emit light. Namely, the source driving circuit 207 may provide a compensated test voltage corresponding to the compensated test data through the data line 204 to drive the pixel circuit 200. In this circumstance, the optical instrument (not shown) may measure the LED display panel to generate optical test data of the LED 203. Based on the optical test data, the TCON circuit 101 may obtain the LED error information indicating errors caused by the LED 203. For example, an actual brightness (i.e., an actual grayscale value) of the LED 203 may be measured by the optical instrument. The compensated test data corresponds to an ideal brightness (i.e., an ideal grayscale value). By comparing the actual brightness (i.e., the actual grayscale value) with the ideal brightness (i.e., the ideal grayscale value), the TCON circuit 101 (or a test platform) may calculate optical error information (i.e., the LED error information) of the LED 203 in the pixel circuit 200. Thus, the TCON circuit 101 may control the source driving circuit 207 based on the compensated test data to drive the LED display panel while an optical measurement may be performed to sense the LED to obtain the LED error information.

The LED error information may be stored in an optical compensation look-up table. The optical compensation look-up table may be implemented in an LED compensation circuit 620 of the timing controller circuit illustrated in FIG. 6. Thus, when the error compensation for the FETs by using the FET error information is completed, the TCON circuit 101, in step 502, may obtain the LED error information indicating errors caused by the LED 203 of the pixel circuit 200.

In step 503, the LED display panel is driven by the source driving circuit 207 to obtain "LED and driving circuit error information". The LED and driving circuit error information may indicate errors caused by the LED 203 and the sensing current (or the driving current) of the source driving circuit 207. For instance, the TCON circuit 101 may control the source driving circuit 207 to drive the LED display panel and turn on all the FETs (e.g., the sensing FET 202) of the LED display panel. The source driving circuit 207 provides the driving current I_LED to drive the LED 203 through the sensing line 205. In this circumstance, the optical measurement may be performed to sense the brightness (i.e., the grayscale) of the LED 203 in step 503, so as to obtain the LED and driving circuit error information. For instance, the optical instrument (not shown) may, in step 503, measure the LED display panel to generate optical data. Based on the optical data, the TCON circuit 101 (or the test platform) may obtain the LED and driving circuit error information. The LED and driving circuit error information may be stored in a look-up table. The look-up table may be placed in a look-up table 640 of the TCON circuit 101 illustrated in FIG. 6.

In other embodiments, the TCON circuit 101, in step 503, may control the source driving circuit 207 to sense the LED 203, so as to obtain the LED and driving circuit error information, wherein all of the FETs in the pixel circuit 200 are turned on. For instance, the source driving circuit 207 may, in step 503, provide a voltage to the data line 204 to drive the LED 203. Then, the source driving circuit 207 may measure the sensing current through the sensing line 205 and converts the sensing current into the optical data. Based on the optical data, the TCON circuit 101 may, in step 503, obtain the LED and driving circuit error information.

The TCON circuit 101 may perform step 504 to obtain driving circuit error information indicating errors caused by the sensing current (or the driving current) of the source driving circuit 207. In step 504, the TCON circuit 101 may obtain the driving circuit error information according to the LED and driving circuit error information obtained in step S503 and the LED error information obtained in step S502. For instance, the TCON circuit 101 may remove an LED error component indicted by the LED error information from the LED and driving circuit error information, so as to obtain the driving circuit error information. After obtaining the driving circuit error information, the driving circuit error information may be recorded in the look-up table 640 of the TCON circuit 101 illustrated in FIG. 6.

In step 505, the TCON circuit 101 may, by using the driving circuit error information related to the source driving circuit 207 obtained in step 504, compensate the electrical information of the LED 203 in the pixel circuit 200 which is currently detected by the source driving circuit 207. The compensated electrical information may be recorded in the electrical compensation look-up table of an LED compensation circuit 630 of the TCON circuit 101 illustrated in FIG. 6.

Figure 6:
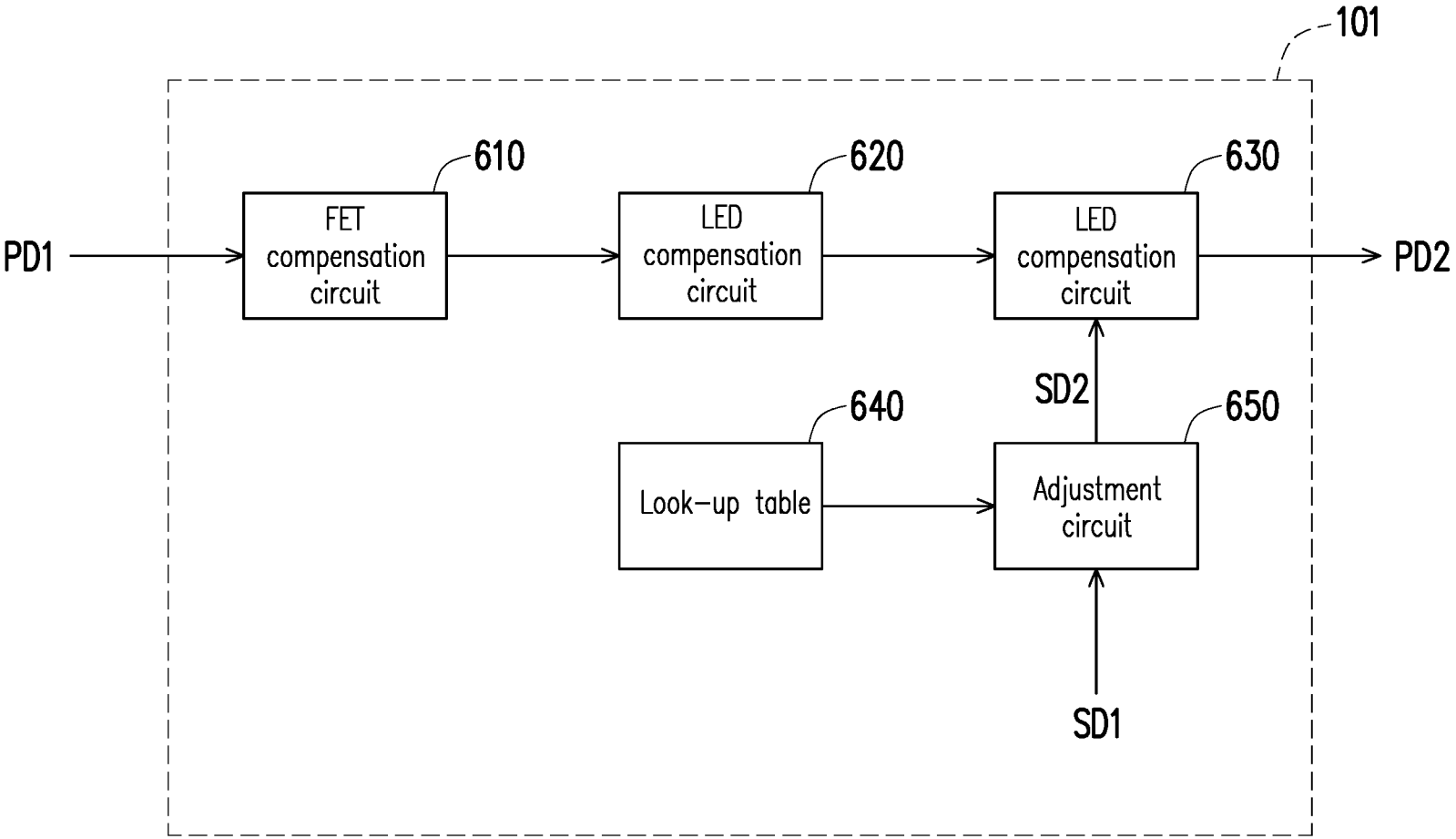
FIG. 6 is a schematic circuit block diagram illustrating the timing controller circuit depicted in FIG. 1 according to an embodiment of the invention.

FIG. 6 is a schematic circuit block diagram illustrating the TCON circuit 101 depicted in FIG. 1 according to an embodiment of the invention. Referring to FIGS. 2 and 6, the TCON circuit 101 may control the source driving circuit 207 to drive the data line 204 of the LED display panel 100 and sense the sensing line 205 of the LED display panel 100.

In a detection operation period, the TCON circuit 101 may obtain the driving circuit error information (step 504) and obtain original LED sensing data SD1 from the source driving circuit 207. In the detection operation period, the TCON circuit 101 may compensate the original LED sensing data SD1 based on the driving circuit error information to generate the LED error information. The LED error information indicates errors caused by the LED 203 of the pixel circuit 200.

In a normal operation period, the TCON circuit 101 may obtain first LED error information. The first LED error information indicates errors caused by the LED 203 of the pixel circuit 200. In the detection operation period before the normal operation period, the TCON circuit 101 may generate and store (or update) the first LED error information. In the normal operation period, the TCON circuit 101 may obtain original pixel data PD1. The TCON circuit 101, in the normal operation period, may compensate the original pixel data PD1 by using the first LED error information to generate compensated pixel data PD2. The TCON circuit 101 may provide the compensate pixel data PD2 to the source driving circuit 207 in the normal operation period, such that the source driving circuit 207 may drive the LED display panel 100 according to the compensated pixel data PD2.

The TCON circuit 101 illustrated in FIG. 6 includes the FET compensation circuit 610, the LED compensation circuit 620, the LED compensation circuit 630, the look-up table 640 and an adjustment circuit 650. The FET error information obtained in step S501 may be recorded in the electrical compensation look-up table in the FET compensation circuit 610. The LED error information obtained in step S502 may be recorded in the optical compensation look-up table in the LED compensation circuit 620. The optical compensation look-up table in the LED compensation circuit may be pre-built in a production line. The driving circuit error information obtained in step 504 may be stored in the look-up table 640. The compensated electrical information obtained in step S505 may be recorded in the electrical compensation look-up table in the LED compensation circuit 630. The electrical compensation look-up table in the LED compensation circuit 630 may be dynamically updated.

Before the detection operation period (e.g., in the production line), steps 501 to 504 illustrated in FIG. 5 may be performed to obtain different error information. The aforementioned different error information may be stored in different look-up tables of the TCON circuit 101 for being used by the TCON circuit 101.

In the detection operation period, the source driving circuit 207 may detect the current electrical information (e.g., information related to the driving current I_LED and/or a driving voltage V_LED) in the LED 203 in the pixel circuit 200 through the sensing line 205, and then returns the original LED sensing data SD1 containing the electrical information to the adjustment circuit 650 of the TCON circuit 101. The adjustment circuit 650 may refer the look-up table 640 recording the driving circuit error information, so as to capture the driving circuit error information related to the source driving circuit 207 from the look-up table 640. In the detection operation period, the adjustment circuit 650 may compensate the original LED sensing data SD1 based on the driving circuit error information, so as to generate compensated LED sensing data SD2 (i.e., the first LED error information). In the detection operation period, the adjustment circuit 650 of the TCON circuit 101 may update the electrical compensation look-up table in the LED compensation circuit 630, so as to record the compensated LED sensing data SD2 (i.e., the first LED error information) in the electrical compensation look-up table having the original LED error information. After the detection operation period ends, the TCON circuit 101 enters the normal operation mode.

In the normal operation period, the FET compensation circuit 610 may compensate the original pixel data PD1 according to the FET error information obtained in step 501 described above to generate first compensated data. An input terminal of the LED compensation circuit 620 is coupled to an output terminal of the FET compensation circuit 610 to receive the first compensated data. In the normal operation period, the LED compensation circuit 620 may compensate the first compensated data according to the LED error information (i.e., second LED error information) obtained in step 502 described above to generate second compensated data. A compensation algorithm of the FET compensation circuit 610 and the LED compensation circuit 620 is not limited in the present embodiment. For instance, the FET compensation circuit 610 and/or the LED compensation circuit 620 may perform a conventional compensation algorithm or other algorithms.

An input terminal of the LED compensation circuit 630 can be coupled to an output terminal of the LED compensation circuit 620 to receive the second compensated data. In the normal operation period, according to the compensated LED sensing data SD2 (i.e., the first LED error information) recorded in the electrical compensation look-up table in the LED compensation circuit 630, the LED compensation circuit 630 may compensate the second compensated data to generate the compensated pixel data PD2 to the source driving circuit 207. A compensation algorithm of the LED compensation circuit 630 is not limited in the present embodiment. For instance, the LED compensation circuit 630 may perform a conventional compensation algorithm or other algorithms. Thus, based on the LED error information, the LED and driving circuit error information, the FET error information and/or the driving circuit error information, the TCON circuit 101 may compensate the original pixel data PD1 in the normal operation period, so as to generate the compensated pixel data PD2 to the source driving circuit 207.

Figure 7:
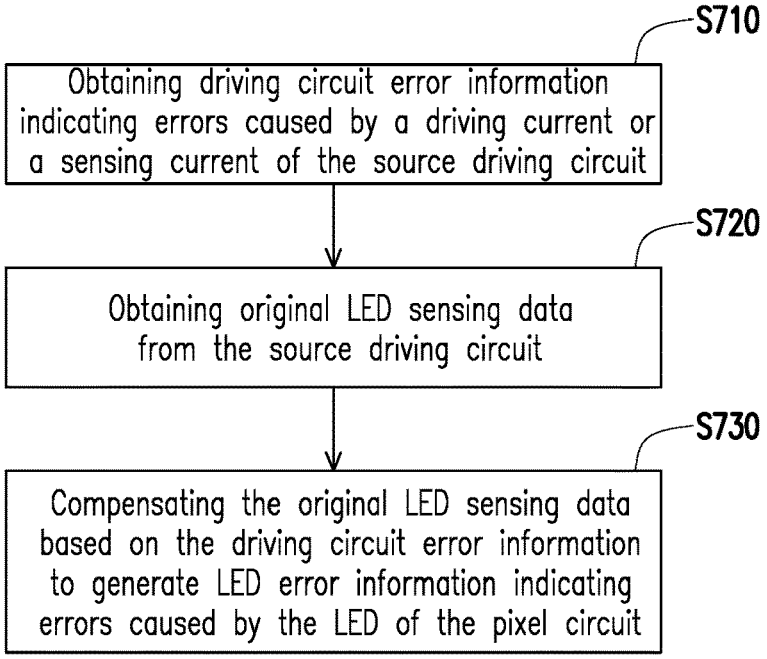
FIG. 7 is a flowchart illustrating an operation method of the TCON circuit in the detection operation period according to an embodiment of the invention.

FIG. 7 is a flowchart illustrating an operation method of the TCON circuit 101 in the detection operation period according to an embodiment of the invention. The TCON circuit 101 is configured to control the source driving circuit 207 to drive the data line 204 of the LED display panel 100 and sense the sensing line 205 of the LED display panel 100. In the detection operation period, the TCON circuit 101 may obtain the driving circuit error information indicating errors caused by the driving current or the sensing current of the source driving circuit 207 (step S710). In the detection operation period, the TCON circuit 101 may obtain the original LED sensing data from the source driving circuit 207 (step S720). In the detection operation period, the TCON circuit 101 may compensate the original LED sensing data based on the driving circuit error information to generate the LED error information indicating errors caused by the LED 203 of the pixel circuit 200.

Figure 8:
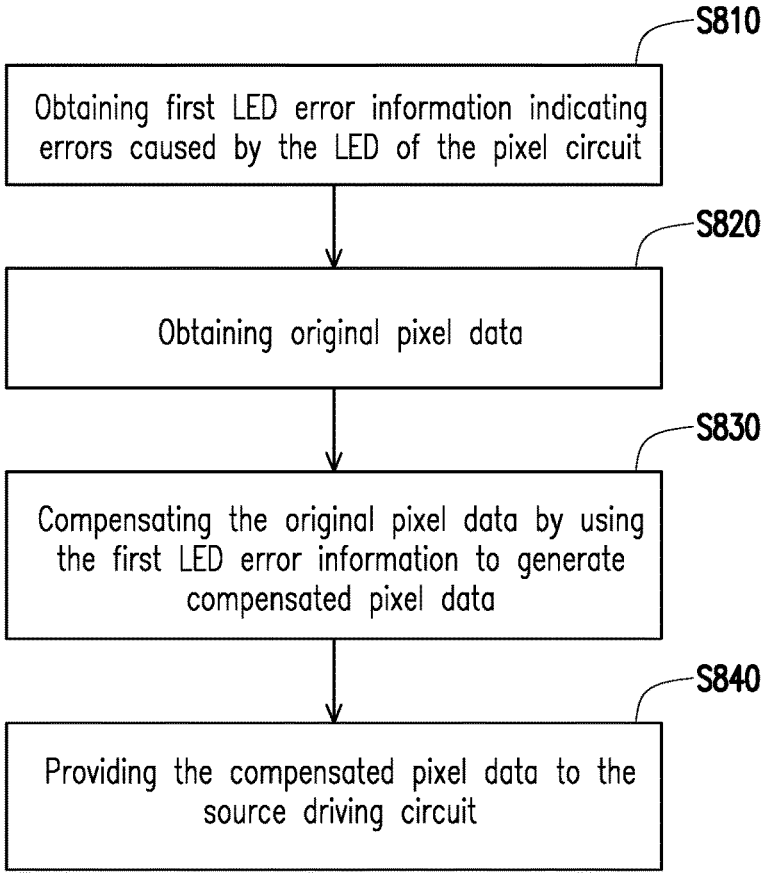
FIG. 8 is a flowchart illustrating an operation method of the TCON circuit in the normal operation period according to an embodiment of the invention.

FIG. 8 is a flowchart illustrating an operation method of the TCON circuit 101 in the normal operation period according to an embodiment of the invention. In the normal operation period, the TCON circuit 101 may obtain the first LED error information indicating errors caused by the LED 203 of the pixel circuit 200 (step S810), wherein the first LED error information is generated and stored or updated in a detection operation period before the normal operation period. In the normal operation period, the TCON circuit 101 may obtain the original pixel data (step S820). In the normal operation period, the TCON circuit 101 may compensate the original pixel data by using the first LED error information to generate the compensated pixel data (step S830). In the normal operation period, the TCON circuit 101 may provide the compensated pixel data to the source driving circuit 207 (step S840) such that the source driving circuit 207 drives the LED display panel 100 according to the compensated pixel data.

Based on the above, the display panel driving circuit and the method for capturing error information thereof provided by the embodiments of the invention can obtain the errors caused by the LED of the pixel circuit (which is the LED error information) and obtain the errors caused by LED and the sensing current (or the driving current) of the source driving circuit (which is the LED and driving circuit error information). According to the LED error information and the LED and driving circuit error information, the display panel driving circuit can obtain the errors caused by the sensing current (or the driving current) of the source driving circuit (which is the driving circuit error information). By applying the captured error information to the compensation algorithm of the display panel, the timing controller circuit can solve an issue of display abnormality resulting from the decay of the LED in the LED display panel along with time. Moreover, the capturing method can be built in the existing LED panel manufacturing process without purchasing additionally any equipment, which can reduce difficulty of introduction and provide applicability in mass production.

It will be apparent to those skilled in the art that various modifications and variations can be made to the structure of the disclosed embodiments without departing from the scope or spirit of the disclosure. In view of the foregoing, it is intended that the disclosure cover modifications and variations of this disclosure provided they fall within the scope of the following claims and their equivalents.

What is claimed is:

1. A method for capturing driving circuit error information indicating errors caused by a source driving circuit for driving a light-emitting diode (LED) display panel, wherein the LED display panel comprises at least one pixel circuit, the pixel circuit comprises at least one field-effect transistor (FET) and an LED, the pixel circuit is connected to a data line and a sensing line of the LED display panel, and the method comprises:

obtaining LED error information indicating errors caused by the LED of the pixel circuit;

driving the LED display panel by the source driving circuit to obtain LED and driving circuit error information indicating errors caused by the LED and a sensing current or a driving current of the source driving circuit; and obtaining driving circuit error information according to the LED error information and the LED and driving circuit error information after the LED error information and the LED and driving circuit error information are obtained respectively, wherein the driving circuit error information indicates errors caused by the sensing current or the driving current of the source driving circuit.

2. The method according to claim 1, wherein the step of obtaining the LED error information comprises:

recording the LED error information in a look-up table.

3. The method according to claim 1, wherein the step of obtaining the LED and driving circuit error information comprises:

recording the LED and driving circuit error information in a look-up table.

4. The method according to claim 1, wherein the step of obtaining the driving circuit error information comprises:

recording the driving circuit error information in a look-up table.

5. The method according to claim 1, wherein the step of obtaining the LED error information comprises:

obtaining FET error information by driving the pixel circuit, wherein the FET error information indicates errors caused by the at least one FET of the pixel circuit; and obtaining the LED error information indicating errors caused by the LED of the pixel circuit when an error compensation for the at least one FET is completed by using the FET error information.

6. The method according to claim 5, wherein the step of obtaining the FET error information comprises:

controlling the source driving circuit to sense the at least one FET so as to obtain the FET error information, wherein the LED is controlled not to emit light.

7. The method according to claim 6, wherein the step of controlling the source driving circuit comprises:

providing a test voltage through the data line to drive the pixel circuit and measuring a corresponding voltage through the sensing line; and obtaining the FET error information indicating errors caused by the at least one FET based on a relation between the test voltage and the corresponding voltage.

8. The method according to claim 6, wherein the at least one FET comprises a switching FET coupled between the data line of the LED display panel and the LED, and a sensing FET coupled between the sensing line of the LED display panel and the switching FET, and the step of controlling the source driving circuit to sense the at least one FET comprises:

turning on the sensing FET and turning off the switching FET.

9. The method according to claim 5, wherein the step of obtaining the LED error information comprises:

compensating original test data by using the FET error information to generate compensated test data;

controlling the source driving circuit to drive the LED display panel based on the compensated test data; and performing an optical measurement to sense the LED so as to obtain the LED error information.

10. The method according to claim 9, wherein the step of controlling the source driving circuit to drive the LED display panel comprises:

providing a compensated test voltage corresponding to the compensated test data through the data line to drive the pixel circuit.

11. The method according to claim 9, wherein the step of performing the optical measurement comprises:

measuring the LED display panel by an optical instrument to generate optical test data of the LED; and obtaining the LED error information indicating errors caused by the LED based on the optical test data.

12. The method according to claim 9, wherein the at least one FET comprises a switching FET coupled between the data line of the LED display panel and the LED, and a sensing FET coupled between the sensing line of the LED display panel and the switching FET, and the step of controlling the source driving circuit to drive the LED display panel comprises:

sequentially turning on and turning off the sensing FET; and turning off the switching FET.

13. The method according to claim 1, wherein the step of obtaining the LED and driving circuit error information comprises:

controlling the source driving circuit to drive the LED display panel so as to turn on all of the at least one FET of the LED display panel; and performing an optical measurement to sense the LED so as to obtain the LED and driving circuit error information.

14. The method according to claim 13, wherein the step of controlling the source driving circuit to drive the LED display panel comprises:

driving the LED by the source driving circuit by providing a driving current to the data line.

15. The method according to claim 13, wherein the step of performing the optical measurement to sense the LED comprises:

measuring the LED display panel by an optical instrument to generate optical data; and obtaining the LED and driving circuit error information based on the optical data.

16. The method according to claim 1, wherein the step of obtaining the LED and driving circuit error information comprises:

controlling the source driving circuit to sense the LED so as to obtain the FET error information, wherein all of the at least one FET is turned on.

17. The method according to claim 16, wherein the step of controlling the source driving circuit to sense the LED so as to obtain the FET error information comprises:

driving the LED by the source driving circuit by providing a voltage to the data line;

measuring a sensing current through the sensing line and converting the sensing current into optical data; and obtaining the LED and driving circuit error information based on the optical data.

18. The method according to claim 1, wherein the step of obtaining the driving circuit error information comprises:

removing an LED error component indicted by the LED error information from the LED and driving circuit error information so as to obtain the driving circuit error information.

19. A driving circuit for driving a light-emitting diode (LED) display panel, wherein the LED display panel comprises at least one pixel circuit, the pixel circuit comprises at least one field-effect transistor (FET) and an LED, the pixel circuit is connected to a data line of the LED display panel and a sensing line of the LED display panel, and the driving circuit comprises:

a timing controller circuit, configured to control a source driving circuit to drive the data line of the LED display panel and sense the sensing line of the LED display panel, wherein in a detection operation period, the timing controller circuit is configured to:

obtain driving circuit error information indicating errors caused by a driving current or a sensing current of the source driving circuit;

obtain original LED sensing data from the source driving circuit; and compensate the original LED sensing data based on the driving circuit error information to generate LED error information indicating errors caused by the LED of the pixel circuit.

20. The driving circuit according to claim 19, wherein the obtaining of the driving circuit error information comprises referring to a look-up table recording the driving circuit error information.

21. The driving circuit according to claim 19, wherein the timing controller is further configured to update a look-up table to record the LED error information in the look-up table which has original LED error information.

22. The driving circuit according to claim 19, wherein the timing controller is further configured to compensate original pixel data based on the LED error information in a normal operation period.

23. A driving circuit for driving a light-emitting diode (LED) display panel, wherein the LED display panel comprises at least one pixel circuit, the pixel circuit comprises at least one field-effect transistor (FET) and an LED, the pixel circuit is connected to a data line of the LED display panel and a sensing line of the LED display panel, and the driving circuit comprises:

a timing controller circuit, configured to control a source driving circuit to drive the data line of the LED display panel and sense the sensing line of the LED display panel, wherein in a normal operation period, the timing controller circuit is configured to:

obtain first LED error information indicating errors caused by the LED of the pixel circuit, wherein the first LED error information is generated and stored or updated in a detection operation period before the normal operation period;

obtain original pixel data;

compensate the original pixel data by using the first LED error information to generate compensated pixel data; and provide the compensated pixel data to the source driving circuit such that the source driving circuit drives the LED display panel according to the compensated pixel data.

24. The driving circuit according to claim 23, wherein the timing controller circuit is further configured to obtain second LED error information indicating errors caused by the LED of the pixel circuit in the normal operation period, wherein the second LED error information is obtained and stored for being used by the timing controller circuit before the detection operation period, and the timing controller circuit is further configured to compensate the original pixel data further by the second LED error information to generate the compensated pixel data.

25. The driving circuit according to claim 24, wherein the timing controller circuit is further configured to obtain FET error information in the normal operation period, wherein the FET error information indicates errors caused by the at least FET of the pixel circuit and is obtained and stored for being used by the timing controller circuit before the detection operation period, and the timing controller circuit is further configured to compensate the original pixel data further by the FET error information to generate the compensated pixel data.

26. The driving circuit according to claim 23, wherein the timing controller circuit is further configured to obtain FET error information in the normal operation period, wherein the FET error information indicates errors caused by the at least FET of the pixel circuit and is obtained and stored for being used by the timing controller circuit before the detection operation period, and the timing controller circuit is further configured to compensate the original pixel data further by the FET error information to generate the compensated pixel data.

27. The driving circuit according to claim 23, wherein during the obtaining of the first LED error information, the timing controller circuit is configured to refer to a look-up table recording the first LED error information.

28. The driving circuit according to claim 27, wherein the timing controller circuit is further configured to update the look-up table by using the first LED error information in the detection operation period before the normal operation period.

29. The driving circuit according to claim 28, wherein in the detection operation period, before the look-up table is updated by using the first LED error information, the timing controller circuit is further configured to:

obtain driving circuit error information indicating errors caused by a driving current or a sensing current of the source driving circuit;

obtain original LED sensing data from the source driving circuit; and compensate the original LED sensing data based on the driving circuit error information to generate the first LED error information.

* * * * *